United States Patent [19]

Ueda et al.

[11] Patent Number: 4,634,003

[45] Date of Patent: Jan. 6, 1987

[54] CONTAINER FOR ACCOMMODATING TWO KINDS OF LIQUIDS

[75] Inventors: Toshihiro Ueda, Ibaraki; Masamichi Imanishi, Ikoma; Kazuo Iyama, Chiba; Akio Fukuhara, Tsukui; Ken Iwase, Hachioji, all of Japan

[73] Assignee: Suntory Limited, Osaka, Japan

[21] Appl. No.: 767,431

[22] Filed: Aug. 20, 1985

[30] Foreign Application Priority Data

| | | | |
|---|---|---|---|
| Aug. 22, 1984 | [JP] | Japan | 59-127349[U] |
| Aug. 23, 1984 | [JP] | Japan | 59-127790[U] |
| Sep. 26, 1984 | [JP] | Japan | 59-145155[U] |
| Sep. 28, 1984 | [JP] | Japan | 59-146896[U] |
| Jun. 18, 1985 | [JP] | Japan | 60-130812 |

[51] Int. Cl.[4] ..... B65D 25/08

[52] U.S. Cl. ..... 206/221; 220/23

[58] Field of Search ..... 220/23, 257, 258; 215/6; 206/219, 220, 221, 222; 222/80, 83

[56] References Cited

U.S. PATENT DOCUMENTS 2,721,552 10/1955 Nosik ..... 206/222

4,264,007 4/1981 Hunt ..... 206/219

*Primary Examiner*—George T. Hall

*Attorney, Agent, or Firm*—Burns, Doane, Swecker & Mathis

[57] ABSTRACT

A container for separately accommodating a pair of liquids, such as mineral water and whisky, including a main body for accommodating a first liquid, a small cup for accommodating a second liquid, provided with a flange extending from the entire periphery of an upper end of the small cup and a skirt extending downward from the entire periphery of an upper end of the flange, and a flexible lid for liquid-tightly sealing an upper free opening of the small cup. The small cup is fit into an upper free opening of the main body engaging the flange and the skirt with the entire periphery of an upper end of the main body. The small cup has a specified area, in a bottom wall, at least partially bordered by a score line. The lid has a downward projection. The specified area is broken by pushing down the lid until a tip of the projection presses to break the specified area, whereby the second liquid flows down into the main body and mixes with the first liquid in the main body.

11 Claims, 19 Drawing Figures

CONTAINER FOR ACCOMMODATING TWO KINDS OF LIQUIDS

BACKGROUND OF THE INVENTION

1. Field of the Invention

The present invention relates to a container for liquids, more particularly to one for accommodating two kinds of liquids separately from each other until the contents are in use.

2. Description of the Related Art

It is a widely used technique in such fields as photographic developers or adhesives to store two kinds of liquids separately from each other for mixing just before use. Recently, such the technique has also become popular in the food industry for maintaining flavor and aroma of individual components.

Japanese Examined Utility Model Publication (Kokoku) No. 53-18138 proposes a container in which a small cup-like plug accommodating one component therein is fit into an upper free opening of a main body accommodating another component. A lid provided with a cutter covers an upper free opening of the plug. In use, the lid is pressed so the cutter breaks a thin bottom wall of the plug, whereby the component in the plug falls into the main body to mix together with it. This container, however, has the drawback in that the assembly of the plug and the lid requires great care due to their delicate structure. This makes automation of the production process difficult. In addition, the plug cannot be removed at once, making dispensing of the content troublesome.

Japanese Examined Utility Model Publication (Kokoku) No. 52-51103 discloses a container similar to the above, in which a cap provided with a cutter is utilized in place of the lid of the abovesaid container. The cap is screwed down around a neck of a main body accommodating a first component and breaks a bottom wall of a plug accommodating a second component. This container has the same drawbacks as stated before.

Japanese Unexamined Utility Model Publication (Kokai) No. 55-7788 discloses a can for coffee in which a top wall is constituted as a double structure having inner and outer plates and the latter is provided with a knife for breaking the inner plate. In use, the outer plate is pressed or struck down toward the inner plate. The knife breaks the latter and an additive contained in a space between the two plates falls down into coffee contained in the can body. Finally, the can is turned upside down and a bottom wall thereof is opened in a usual manner. This can, however, is not used for accommodating a liquid type additive in the space of the top wall due to lack of sealability between the inner and outer plates. Even for powdery or solid type additives, there may be a risk of contamination. Moreover, since the broken opening of the inner plate is small, the coffee mixture tends to remain in the space between the two plates upon pouring.

Japanese Unexamined Utility Model Publication (Kokai) No. 58-21566 proposes a container for two kinds of liquids comprising a cup-like main body for a first liquid and an inverted cup-like lid for a second liquid having an inward projection at a center of a bottom wall thereof. A diaphragm is sealingly provided between the two. Although this container is simple in structure, manufacture is very difficult. The lid and the main body must be joined with the thin diaphragm therebetween while the liquids are contained therein.

Japanese Unexamined Utility Model Publication (Kokai) No. 59-109678 discloses a container comprising a main body for a first liquid and an easy removable lid with a tab. A small cup for a second liquid is attached to an inside surface of the lid. A bottom wall of the small cup has a weakened line along the width thereof formed by a cut reinforced with an adhesive. In use, the lid is raised up in a cantilever manner by the tab, whereby the lid is bent upward and simultaneously the bottom wall of the small cup is broken along the weakened line. This container, however, has a drawback in that a relatively large force is required to cause the breakage of the small cup because it occurs only after the lid is bent.

SUMMARY OF THE INVENTION

It is a primary object of the present invention to eliminate the abovesaid drawbacks of the prior art and to provide a container for accommodating two kinds of liquids which is easy to assemble, capable of reliably mixing the contents in use, and complete dispensing the mixed content therefrom.

The object is achievable by a container including a main body for accommodating a first liquid therein having a free opening at an upper end thereof; a small cup for accommodating a second liquid therein, provided with a flange extending outward from substantially the entire periphery of an upper end of the small cup and a skirt extending downward from substantially the entire periphery of an outer end of the flange, the small cup being fit into the free opening of the main body with the flange and skirt engaged with the entire periphery of an upper end of the main body; and a flexible lid for liquid-tightly closing an upper opening of the small cup. The small cup has, in a bottom wall thereof, a specified area at least partially bordered by a score line. The lid has, at a part corresponding to the specified area of the small cup, a projection extending toward the specified area. According to this structure, when necessary, the specified area of the small cup is broken by pushing the lid downward until a tip end of the projection is pressed against the specified area, whereby the second liquid flows down into the main body and mixes with the first liquid in the main body.

The skirt of the small cup may be bent inward along the entire periphery of a lower end thereof to engage with the entire periphery of the upper end of the main body and may be provided with a tab integrally extending from a part of the lower end thereof.

The skirt of the small cup preferably has at least two pairs of slits and/or score lines extending upward from the lower end of the skirt, while the slits and/or score lines of each pair is positioned in symmetry with each other relative to a diameter of the small cup passing through the tab.

A recess for receiving the tip end of the projection is preferably provided in the specified area of the small cup.

The slits and/or score lines are preferably inclined relative to a height thereof.

The skirt of the small cup may be provided with a notch at a position in the lower end thereof diametrically opposite to the tab.

In another aspect of the present invention, the lid has a skirt extending downward from the entire periphery thereof. A height of the skirt is larger than that of the skirt of the small cup. A lower end of the latter skirt is spaced outward from an outer wall of the main body and resiliently displaceable close to and apart from the outer wall of the main body. A lower end of the skirt of the lid is bent inward to form a plurality of protrusions. A diameter of an imaginary circle passing through the innermost edge of the protrusions is smaller than that of an imaginary circle along the lower edge of the skirt of the small cup. The main body has at least a rib constituting a thread around a neck portion thereof. The skirt of the lid is threadedly engageable, along the inwardly bent portion thereof, with the rib to provide a liquid-tight sealing of the container.

The skirt of the small cup preferably has a plurality of slits extending upward from the lower end of the skirt.

BRIEF DESCRIPTION OF THE DRAWINGS

Other objects and advantages of the present invention will be apparent from the description of the preferred embodiments of the present invention with reference to the accompanying drawings: wherein.

DESCRIPTION OF THE PREFERRED EMBODIMENTS

Figure 1:
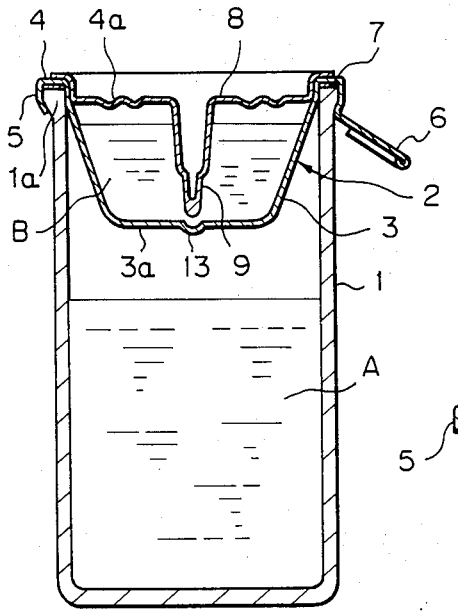
FIG. 1 is a side sectional view of a first embodiment of a container according to the present invention.
Figure 3:
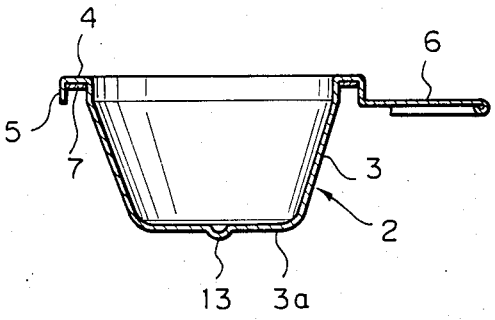
FIGS. 3 and 4 are side sectional and top views of a small cup of the first embodiment, respectively.
Figure 2:
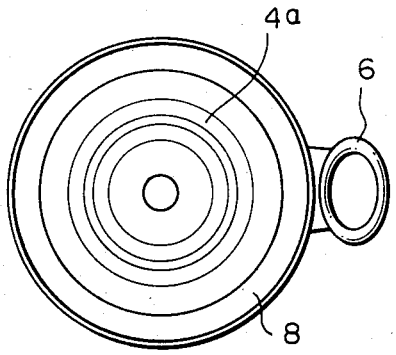
FIG. 2 is a top view of the first embodiment shown in FIG. 1.
Figure 4:
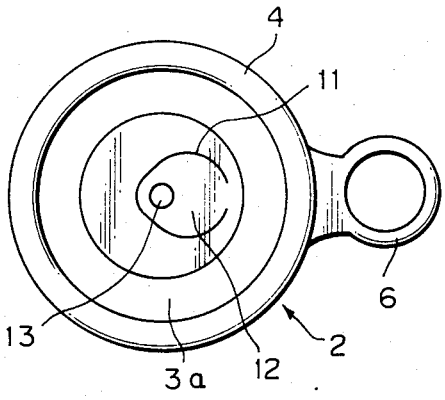
Figure 5:
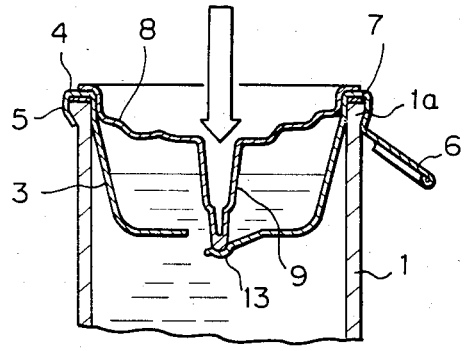
FIG. 5 is an explanatory view illustrating the breakage operation of the small cup.
Figure 6:
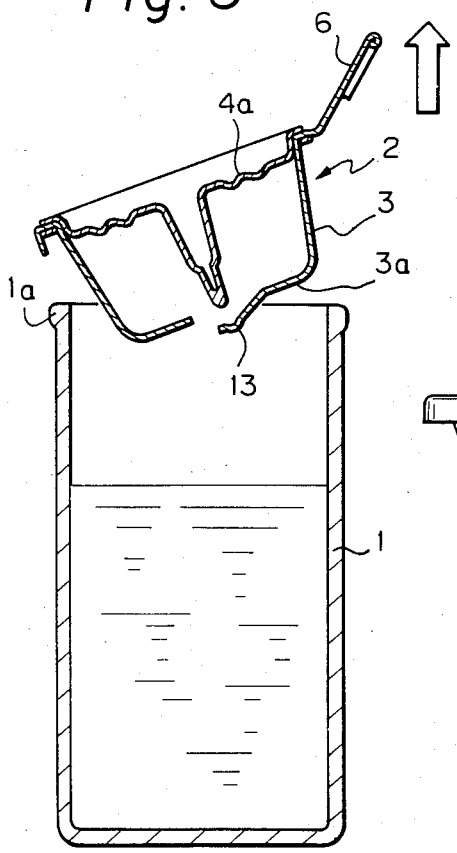
FIG. 6 is an explanatory view illustration the removal operation of the small cup from a main body.

In a first embodiment of a container according to the present invention illustrated in FIGS. 1 through 7, a main body 1 is of a cup shape having a beaded upper edge 1*a* and is made, for example, of glass. The main body 1 contains therein a first liquid A (e.g., mineral water or juice.) A small cup 2 is fit in an upper free opening of the main body 1, which is made of a thin metal sheet of aluminum or the like and contains therein a second liquid (e.g., whisky, brandy, or other spirit). The small cup 2 consists of a receptacle portion 3 having a smaller diameter toward a bottom wall thereof, a flange 4 extending outward from the entire periphery of an upper end of the receptacle portion 3, a skirt 5 extending downward from the entire periphery of a lower end of the flange 4, and a tab 6 extending outward form a part of a lower end the skirt 5. The small cup 2 sealingly covers the upper side of the main body 1 by engaging the flange 4 on the beaded edge 1*a* of the main body 1 and inwardly crimping the skirt 5 along a lower periphery of the beaded edge 1*a*. For enhancing the liquid-tight sealing, a sealant 7 may be applied between the beaded edge 1*a* and the flange 4 and/or the skirt 5.

Figure 7:
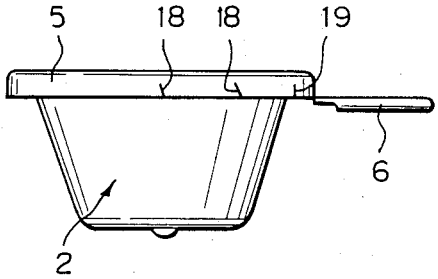
FIG. 7 is a side view of the small cup.

The skirt 5 has two pairs of slits 18 and a pair of score lines 19 extending upward from a lower end of the skirt 5 for easy removal of the small cup 2 from the main body 1, as shown in FIG. 7. The slits 18 and score lines 19 are preferably provided at symmetrical points on the skirt 5 relative to a diameter passing through the tab 6, more preferably in the vicinity of a root of the tab 6 and/or at points where another diameter perpendicular to the symmetry line intersects the skirt 5. The number of pairs of the slits and/or the score lines is preferably more than three. Here, the "score line" stands for a narrow groove provided on one side of a surface not reaching the opposite side of the surface.

Figure 9:
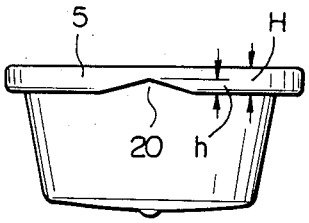
FIG. 9 is a front view of the small cup illustrating a notch provided on the skirt.

A notch 20 is provided on the skirt 5 at a position diametrically opposite to the tab 6 (FIG. 9). A height h of the notch 20 is preferably less than half a height of the skirt H for ensuring the sealing effect.

A lid 8 is provided for covering an upper free opening of the small cup 2. The lid 8 is preferably made of a single or multi-layered synthetic resin sheet such as polyester or polyethylene, at least one of the layers having a good gas-barrier property, and is fixed on the flange 4 by means of heat sealing or an adhesive.

In a center of the lid 8, a projection 9 is protruded downward until a tip thereof reaches the vicinity of a bottom wall 3*a* of the receptacle portion 3. The projection 9 is preferably of an elongated conical shape but may be of other shapes as well provided they are rigid in structure. In this embodiment, though the projection 9 is formed integrally with the lid 8, it may be manufactured separately from the latter and attached thereto by melt-adhesion or press-fitting.

The lid 8 has a corrugation 4*a* for facilitating deformation thereof to sufficiently lower the projection 9 when the depressing force is applied to the lid 8.

A specified area 12 is provided in the bottom wall 3*a* of the receptacle portion 3 partly bordered by a score line 11 for being easily broken by the pressing down of the projection 9. In the specified area 12, a recess 13 is provided for receiving the tip of the depressed projection 9, whereby the projection 9 can effectively break the score line 11 when pressed down without lateral movement relative to the bottom wall 3*a*, even with slippage between the tip of the projection and the bottom wall 3*a*.

The pattern and cut depth of the score line 11 may be arbitrarily determined, however, a part thereof to be broken at first preferably has a smaller radius of curvature to minimize breakage energy. Also, the score line 11 may have a pattern completely encircling the area 12. In this case, however, the recess 13 is preferable deviated form the center of the area 12 in order to prevent complete breakage along the score line and falling down of the broken piece into the main body.

Next, assembly of the container will be explained.

At first, the first liquid A is filled in the main body 1 in a known manner. Hot packing is the most preferable when the first liquid A is mineral water, juice, or the like from the viewpoint of prevention of the quality deterioration of the contents and the ease of the process.

The small cup 2 is fit to the upper free opening of the main body 1 while the receptacle portion 3 is inserted therein. Then, the skirt 5 is bent inward along a lower edge of the entire periphery of the beaded edge 1*a* of the main body 1 so that the liquid-tight sealing is obtained above the main body 1.

Thereafter, the second liquid B is filled in the small cup 2 and the lid 8 is fit thereon while the projection 9 is directed downward. A liquid-tight seal between the small cup 2 and the lid 8 is obtained by heat sealing or adhering the periphery of the lid 8 to the flange 4.

Alternatively, at first, the second liquid B is filled in the small cup 2, the lid is applied and sealed thereon, and, thereafter, the main body 1 is filled with the first liquid A, covered with the small cup 2, and, finally, the liquid-tight seal therebetween is attained by crimping the skirt 5 along the lower edge of the beaded edge 1*a* of the main body 1, as stated before.

During assembly, a covering label (not shown) indicating the contents, instructions for opening, and/or a trademark is preferably laid on the lid 8. To avoid undesirable depression of the projection 9 during storage, a certain space may be provided between the center portions of the covering label and the lid 8.

In use, the covering label is removed, if existing, and the lid 8 is depressed at the center portion downward by a finger so that a depression force is applied on the recess 13 of the bottom wall 3*a* of the small cup 2 by the tip of the projection 9. Thereby, the score line 11 in the vicinity of the recess 13 is broken. Then, as a result of the increased shearing force caused by further downward movement of the projection 9, the breakage of the residual part of the score line 11 follows thereto.

Due to the above-mentioned breakage of the area 12, the second liquid B contained in the small cup 3 easily flows down and mixes with the first liquid A in the main body 1. After the mixture of the two liquids A and B, the tab 6 is pulled forward and then lifted upward by a finger, whereby the score line 19 provided in the vicinity of the root of the tab 6 begins to break. When the breakage reaches the flange 4 beyond the skirt 5, the interior of the main body 1 is released from the slight vacuum usually created by cooling after hot packing. The force pulling up the tab 6 works to remove the small cup 2 upward from the main body 1, whereby the lower end of the skirt 5 in the vicinity of the tab 6 climbs over the beaded edge 1*a*. This is followed by widening of the width of the slits 18 and by releasing of the tight engagement between the skirt 5 and the beaded edge 1*a*. The notch 20 enhances the easy removal of the skirt 5 from the main body 1 at the final stage of the operation. In this embodiment, since the receptacle portion 3 has a tapered profile with a smaller diameter directing downward and there is a sufficient gap between an outer wall of the small cup 2 and an inner wall of the main body 1, the small cup 2 can be easily and completely dismounted from the main body 1 along with the lid 8. Thus, the mixture of the liquids A and B is not only easily poured to another receptacle but also one can drink it directly from the main body 1.

Figure 8:
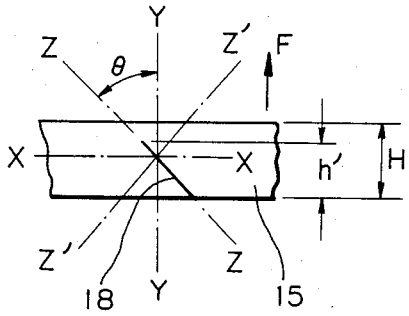
FIG. 8 is an enlarged partial view of a skirt of the small cup illustrating a slit provided thereon.

The effect of the slit 18 and/or the score line 19 will be explained in more detail as follows with reference to FIG. 8.

The slit 18 (or score line 19) is preferably inclined to a vertical line Y—Y along height H of the skirt 18 at an angle $\theta$, where $\theta$ is $30° < \theta < 60°$, preferably about 45°. A height h must be less than ½ of H as is the case of the notch 20. According to the inventors' experiment, when a force is imparted on a portion 15 where the slit 18 is to be provided by pulling up the tab 6 in the direction indicated by an arrow F, the largest stress is generated in the direction of Z—Z ($\theta \approx 45°$) and subsequently decreases in the directions of Y—Y and X—X. Thus, if the slit is provided in the direction of Z—Z or Z'—Z', the V-shaped deformation of the slit can be effected even by minimum force. Further, in the region closer to the tab relative to a center of the small cup, a stretching force is exerted to the skirt and, contrary thereto, in the region further from the tab, a compressive force is exerted. That is, provision of the slits 18 or score lines 19 is effective for decreasing the stretching force required for the opening operation of the small cup. The following table shows the difference of forces necessary for removing the small cup form the main body between containers having small cups with slits of different inclination and number.

TABLE

Figure 10:
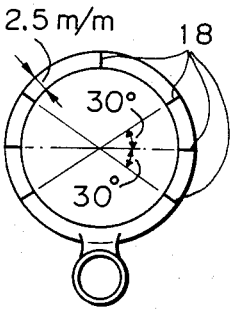
FIGS. 10 through 13 are top view of the small cup illustrating various positions of the slits and/or the notch on the skirt of the small cup, respectively.
Figure 11:
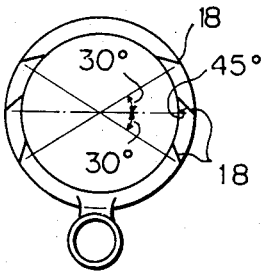
Figure 12:
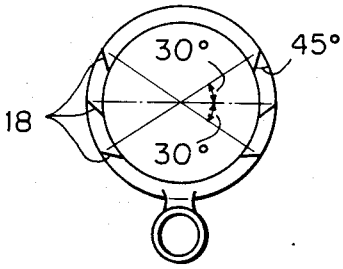
Figure 13:
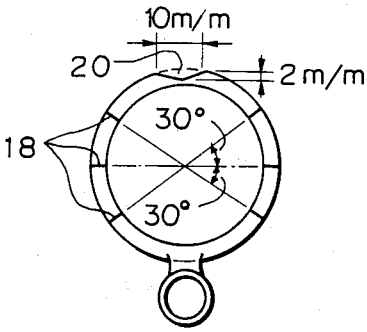

| Type of slit | Force required for removing small cup (Kg) |
|---|---|
| Perpendicular slit, FIG. 10 | 2.04 |
| Inclined slit, FIG. 11 | 1.66 |
| Inclined slit, FIG. 12 | 1.79 |
| Perpendicular slit with notch, FIG. 13 | 1.73 |

According to the inclined slit or score line, the force caused by pulling up the tab is more effectively exerted thereon than the case of the perpendicular slit. Further, the notch is also effective for opening operation of the container.

For example, if the liquids A and B are mineral water and whisky, respectively, a whisky-and-water drink is obtained. If a lemon juice and a spirit are adopted, one can enjoy a lemon cocktail at any place and any time.

According to one example of the present invention, the dimensions of the container are as follows:

Main body made of glass
- Inner diameter: 51.8 mm
- Outer diameter: 60.0 mm

Small cup made of aluminum alloy
- Thickness: 0.20 mm
- Height of receptacle: 27.6 mm
- Outer diameter of bottom wall: 43 mm
- Larger diameter of specified area: 16 mm
- Smaller diameter of specified area: 6 mm
- Diameter of recess: 4.8 mm
- Depth of recess: 1.7 mm Lid
- Height of lid except for projection: 3.0 mm
- Length of projection: 22.2 mm
- Diameter of tip of projection: 3.0 mm
- Distance between tip of projection and bottom wall of recess: 3.4 mm The small cup is not limited to one having a tapered profile as shown in this embodiment, but may be of another shape provided a gap sufficient to remove the small cup form the main body is formed between the inner wall of the latter and the small cup.

Since the structure according to this embodiment is very simple, a conventional process can be utilized for assembly thereof. Since the small cup can easily and completely be removed from the main body together with the lid, one can drink, at a desired rate, the mixture directly from the main body, emptying the main body completely. Since the small cup is accommodated within the main body, damage during transportation and storage can be minimized.

A second embodiment of the present invention will be explained with reference to FIGS. 14 through 19.

The second embodiment comprises a main body 21, a small cup 22, and a lid 28 corresponding, respectively, to the main body 1, the small cup 2, and the lid 8 of the first embodiment. The main body 21 is a cup-shaped receptacle for accommodating a first liquid A, such as mineral water or juice. The main body 21 is preferably made of glass or plastic and has a beaded edge 21*a* around the entire periphery of an upper free opening thereof. The small cup 22 is preferably made of a thin metal sheet or a plastic sheet or a combination thereof and is provided with a receptacle portion 23 for accommodating a second liquid B, such as whisky, brandy, or another spirit. A flange 24 extends outward from the entire periphery of the receptacle portion 23, and a skirt 25 extends downward from the entire periphery of the flange 24. The small cup 22 is fit in the free opening of the main body 21 while the flange 24 is placed on an upper end 44 of the main body 21. A middle portion of the skirt 25 is bent inward along a lower end of the beaded edge 21*a* by means of a crimper (not shown), whereby the interior of the main body 21 is sealed from the outer air. For enhancing the sealing effect, a suitable sealing element 27 may be placed between the flange 24 and the upper end 44 of the main body 21. In place of the sealing element 27, a releasable adhesive may be applied thereto, provided it does not affect the contents.

Figure 15:
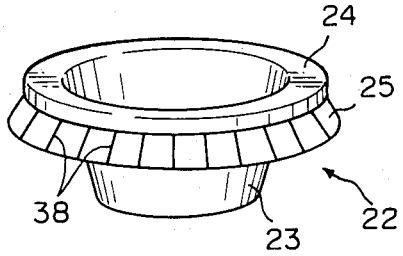
FIG. 15 is a perspective view of a small cup of the second embodiment shown in FIG. 14.

The skirt 25 is different from the first embodiment in that it is provided with a plurality of slits 38 extending upward from the entire periphery of a lower end of the skirt 25, as illustrated in FIG. 15, and lacks a tab for pulling up the small cup.

Figure 14:
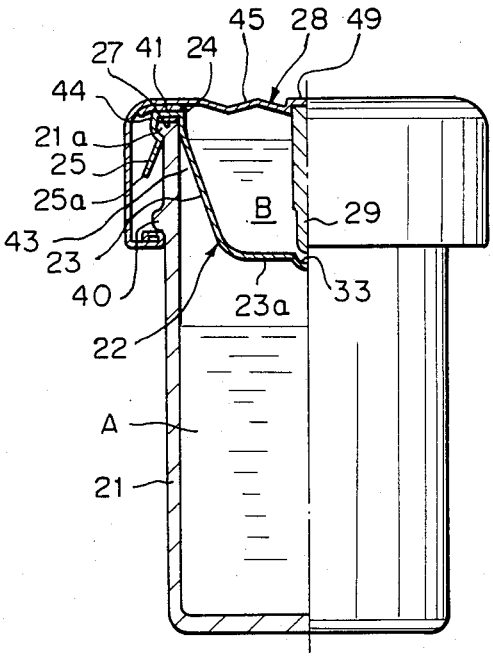
FIG. 14 is a side sectional view of a second embodiment of a container according to the present invention.
Figure 16:
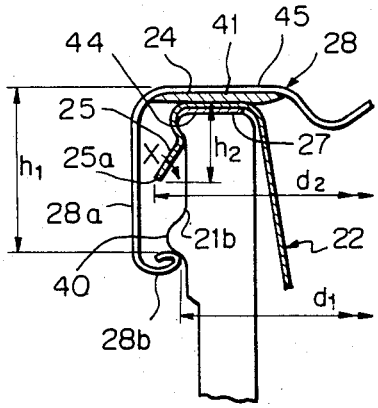
FIG. 16 is an enlarged partial view illustrating the connection between the respective parts of the container of the second embodiment.

As shown in FIGS. 14 and 16, a lower edge 25*a* of the skirt 25 is expanded outward from an outer wall of the main body 21 and is easily resiliently displaceable in the direction indicated by an arrow X due to a function of the slits 38 when external force is applied thereon.

The flexible lid 28, preferably made of a thin metal sheet such as aluminum alloy or tin-free steel, covers an upper free opening of the small cup 22 by liquid-tight contact of an inner surface of a top wall 45 of the lid 28 with the flange 24 of the small cup 22 via an annular sealing element 41.

The lid 28 is provided with a projection 29 at a center thereof and annular corrugations on a top wall 45 thereof for easy downward displacement of the projection 29, as is the case of the first embodiment.

Also, the bottom wall 23*a* of the receptacle portion 23 of the small cup 22 is provided with a specified area 32 partly encircled by a score line and a recess which, respectively, are identical to those 12, 11, and 13 of the first embodiment.

Figure 17:
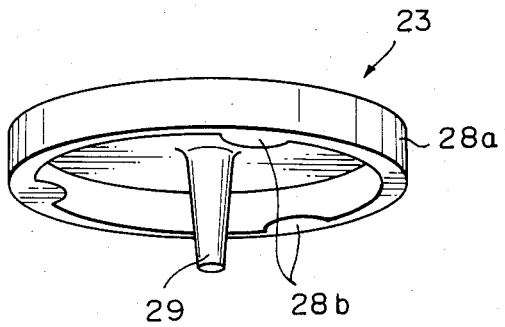
FIG. 17 is a perspective view of a lid of the second embodiment.

As shown in FIG. 16, the lid 28 expands so that a periphery portion of the top wall 45 extends outward over the flange 24 of the small cup 22 and downward from the entire periphery to form a skirt 28*a* covering an upper outer wall 21*b* of the main body 21. The skirt 28*a* has a plurality of inner protrusions 28*b* at proper distances from each other. each of which is formed by a deeply bent part of a periphery of a lower end of the skirt 28*a* (FIG. 17). When the main body 21 and the small cup 22 are sealingly engaged with each other, a diameter $d_1$ of an imaginary circle passing through all the protrusions 28*b* must be smaller than a diameter $d_2$ of another imaginary circle along a lower edge 25*a* of the skirt 25 of the small cup 22. Further, a height $h_1$ from a top wall 45 to the upper edge of the protrusion 8*b* must larger than a height $h_2$ of the skirt 25.

Figure 18:
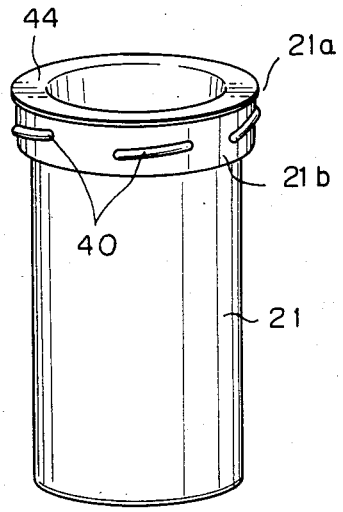
FIG. 18 is a perspective view of a main body of the second embodiment.

As shown in FIG. 18, a plurality of spiral ribs 40 are provided on the upper outer wall 21*b* of the main body 21. The ribs 40 are arranged at a pitch corresponding to that of the protrusion 28*b*. A level at which the ribs 40 are arranged is decided so that, when the lid 28 is capped on the main body 21, a firm screw engagement of the protrusion 28*b* with a lower surface of the rib 40 is achievable by twisting of the lid 28 in the proper direction.

The assembly of the second embodiment is similar to that of the first except for capping of the lid 28. The capping is carried out by fitting the small cup 22 already covered with the lid 28 on the main body 21 and twisting the lid 28 in the proper direction for screw engagement of the protrusion 28*b* with the rib 40 until the annular sealing element 41 provided between the inner surface of the top wall 45 of the lid 28 and the upper surface of the flange 24 is sufficiently pressed by the both of them to form a liquid-tight seal. During the capping operation, the protrusion 28*b* rides over the lower edge 25*a* of the skirt 25, while resiliently displacing it in the direction indicated by the arrow X in FIG. 16. This displacement of the skirt 25 is enhanced by provision of the slits 38, even though the small cup 22 is made of a rather rigid material.

According to the second embodiment of the present invention, the opening operation of the container is carried out by pressing down the projection 29 to break the bottom wall 23*a* of the receptacle portion 23 and unscrewing the lid 28 in the direction reverse to that when assembling the container. By pulling up the lid 28, the small cup 22 is removed from the main body 21 together with the lid 28 due to hooking engagement of the protrusion 28*b* with the lower edge 25*a* of the skirt 25. If one wishes to store any undrunk mixture after opening the container, the lid 28 with the small cup 22 attached thereto can be capped on the main body 21 in the same manner as stated above. Thus, even if the container falls, the contents are safely kept without leakage because the lid 28 and the main body 21 are liquid-tightly sealed by the screw engagement of the rib 40 and the protrusion 28*b*.

Figure 19:
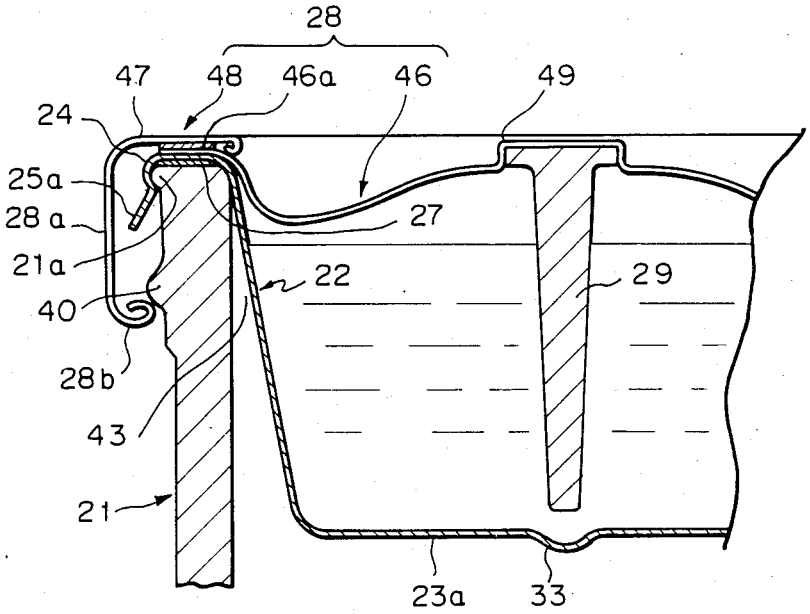
FIG. 19 is an enlarged partial view of a modification of the second embodiment illustrating the connection between the respective parts thereof.

As shown in FIG. 19, the lid 28 may be constituted by two pieces, i.e., a disc member 46 and an annular member 48. In this modification, the projection 29 is also prepared separately from the disc member 46 and fit in a recess 49 on the disc member 46. The two members 46 and 48 are fixed by an adhesive such as polyester resin in peripheral regions 47 and 46*a* of the annular member 48 and the disc member 46, respectively.

We claim:

1. A container for accommodating two kinds of liquids therein separately from each other, comprising a main body for accommodating a first liquid therein, said main body having an opening at an upper end thereof;

a cup for accommodating a second liquid therein, provided with a flange extending outwardly from substantially the entire periphery of an upper end of said cup and a skirt extending downwardly from substantially the entire periphery of an outer end of said flange, said cup fitted into the opening of said main body with said flange and said skirt engaging the entire periphery of an upper end of said main body; and a flexible lid liquid-tightly sealing an upper opening of said cup;

said cup having, in a bottom wall thereof, an area at least partially bordered by a score line and said lid having a projection extending toward said area;

whereby said specified area of said small cup may be broken by pushing said lid downwardly until a tip end of said projection presses onto said specified area;

said skirt of said cup being bent inwardly along the entire periphery of a lower end thereof to engage the entire periphery of the upper end of said main body and provided with a tab integrally extending from a part of the lower end thereof;

said skirt of said cup having at least two pairs of linear weakenings extending upwardly from the lower end of said skirt, each pair of linear weakenings being positioned symmetrically in relation to said tab.

2. The container defined by claim 1, wherein a recess for receiving the tip end of said projection is provided in said specified area of said small cup.

3. The container defined by claim 1, wherein said slits and/or score lines are inclined relative to a longitudinal axis of said main body.

4. The container defined by claim 1 wherein said skirt of said cup is provided with a notch at a location along the lower end thereof opposite of said tab.

5. A container defined by claim 1, wherein said lid has a skirt extending downward from the entire periphery thereof, a height of said skirt being larger than that of the skirt of said small cup; a lower end of the latter skirt is spaced outward from an outer wall of said main body and resiliently displaceable close to and apart from said outer wall of said main body; a lower end of said skirt of said lid is bent inward to form a plurality of protrusions, a diameter of an imaginary circle passing through the innermost edge of said protrusions being smaller than that of an imaginary circle along said lower edge of said skirt of said small cup; and said main body has at least a rib constituting a thread around a neck portion thereof, said skirt of said lid being treadedly engageable, along the inwardly bent portion thereof, with said rib to provide liquid-tight sealing of said container.

6. A container defined by claim 5, wherein said skirt of said small cup has a plurality of slits extending upward from the lower end of said skirt.

7. The container defined by claim 2 wherein said skirt of said cup is provided with a notch at a location along the lower end thereof opposite of said tab.

8. The container defined by claim 3 wherein said skirt of said cup is provided with a notch at a location along the lower end thereof opposite of said tab.

9. The container defined by claim 1, wherein said pairs of linear weakenings include pairs of slits.

10. The container defined by claim 1, wherein said pairs of linear weakenings include pairs of scored lines.

11. The container defined by claim 1, wherein said pairs of linear weakenings include both a pair of scored lines and a pair of slits.

* * * * *